US006692107B2

(12) United States Patent
Lattuca et al.

(10) Patent No.: US 6,692,107 B2
(45) **Date of Patent: *Feb. 17, 2004**

(54) INK CARTRIDGE BODY AND CARRIER ASSEMBLY

(75) Inventors: Michael D. Lattuca, Lexington, KY (US); James P. Harden, Lexington, KY (US); Larry S. Foster, Lexington, KY (US); Frank M. Hughes, Paris, KY (US); Darren W. Tosh, Lexington, KY (US); Michael S. Leiter, Lexington, KY (US); Benjamin A. Askren, Lexington, KY (US); David A. Ward, Lexington, KY (US); Brian D. Smith, Lexington, KY (US); Robert A. Samples, Lexington, KY (US); Donn D. Bryant, Lexington, KY (US); Paul D. Horrall, Lexington, KY (US); David M. Cseledy, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 66 days.
This patent is subject to a terminal disclaimer.

(21) Appl. No.: 09/865,924

(22) Filed: May 25, 2001

(65) Prior Publication Data

US 2001/0048453 A1 Dec. 6, 2001

Related U.S. Application Data

(60) Provisional application No. 60/208,398, filed on Jun. 1, 2000.

(51) Int. Cl.[7] ..... B41J 2/14; B41J 23/00

(52) U.S. Cl. ..... 347/49; 347/37

(58) Field of Search ..... 347/49, 37

(56) References Cited

U.S. PATENT DOCUMENTS

| | | | |
|---|---|---|---|
| 4,227,219 | A | 10/1980 | Takemoto |
| 4,468,144 | A | 8/1984 | McMahon et al. |
| 4,550,320 | A | 10/1985 | Biser et al. |
| 4,576,496 | A | 3/1986 | Schwarz et al. |
| 4,628,332 | A | 12/1986 | Matsumoto |
| 4,643,602 | A | 2/1987 | Ikeda et al. |
| 4,709,245 | A | 11/1987 | Piatt |
| 4,872,026 | A | 10/1989 | Rasmussen et al. |
| 4,970,533 | A | 11/1990 | Saito et al. |
| 5,368,403 | A | 11/1994 | Broder et al. |
| 5,408,746 | A | 4/1995 | Thoman et al. |
| 5,461,405 | A | 10/1995 | Lehmann et al. |
| 5,467,116 | A | 11/1995 | Nakamura et al. |
| 5,504,513 | A | 4/1996 | Nobel et al. |
| 5,592,202 | A | 1/1997 | Erickson |
| 5,593,240 | A | 1/1997 | Broder et al. |

(List continued on next page.)

FOREIGN PATENT DOCUMENTS

EP 0 650 848 A2 3/1995

*Primary Examiner*—Judy Nguyen
(74) *Attorney, Agent, or Firm*—Luedeka, Neely & Graham, P.C.

(57) ABSTRACT

The invention relates to an ink cartridge body which is removably mountable in a printer carriage area of an ink jet printer and an alignment and latching mechanism for the ink cartridge body. The printer carriage area includes at least first and second spaced-apart elongate guide rails and the ink cartridge body includes a printhead and at least two bearing points at predetermined locations on the ink cartridge body, each of the bearing points disposed on the cartridge body for separately engaging at least one of the elongate guide rails for aligning and maintaining the printhead in a predetermined orientation relative to the print media in the printer. The invention substantially reduces the number of parts and tolerances thereof required for aligning a printhead relative to a print media by directly aligning the cartridge body rather than the carrier in the carriage area of the printer.

22 Claims, 12 Drawing Sheets

U.S. PATENT DOCUMENTS 5,617,128 A 4/1997 Thoman et al.
5,629,725 A 5/1997 Buican
5,642,143 A 6/1997 Rhoads
5,646,665 A 7/1997 Swanson et al.
5,782,184 A 7/1998 Albertalli et al.
5,867,188 A 2/1999 Murayama et al.
5,871,292 A 2/1999 Johnson et al.
6,386,681 B1 * 5/2002 Askren et al. ..... 347/49

* cited by examiner

INK CARTRIDGE BODY AND CARRIER ASSEMBLY

This application is a continuation-in-part of provisional application Ser. No. 60/208,398, filed Jun. 1, 2000.

TECHNICAL FIELD

This invention relates to the field of ink jet printers. More particularly, this invention relates to an improved ink jet printer ink cartridge and ink cartridge body carrier and a method for alignment of the ink cartridge body relative to a print media.

BACKGROUND OF THE INVENTION

There are a variety of factors which ultimately determine the print quality obtained from an ink jet printer. However, the position and alignment of the printheads relative to the print media is one of the most important factors to be taken into account when designing a printer. The printheads include a number of nozzles which expel ink based on input image data fed into the printer. If the printheads are not aligned and positioned properly, the resulting printed image may not reflect the true image that is inputted into the printer for printing. Therefore, there is a need to provide an ink jet printer having printheads that are aligned and positioned within an ink jet printer to produce a high-quality replica of the input image data.

Alignment of the printheads to the print media is conventionally achieved indirectly by means of an aligned carriage. The carriage provides a dual-purpose function within the ink jet printer. First, the carriages provide secure connection of the printheads to the printer. More importantly, however, the carriage is aligned in the printer to provide indirect alignment and positioning of the printheads relative to the print media to ensure a quality printed image.

Accordingly, such carriages include bearing and alignment surfaces located on the carriage body for translating the carriage attached printheads back and forth along guide rails within the printer. The back and forth carriage translation enables the printheads to expel ink at various locations on the print media. Alignment of the printheads to the carriage is also important for print quality. The carriage and printheads therefore include a number of tolerances that a manufacturer must pay careful attention to when manufacturing the printer and associated printer components. If one or more of these tolerances are not adhered to, there can be a serious deterioration in the ink jet printer print quality. What is needed, therefore, is a means to reduce the number of tolerances associated with printhead alignment relative to a print media within an ink jet printer without adversely affecting print quality.

With regard to the foregoing and other objects, the present invention is directed to a unique ink cartridge body and cartridge body translation mechanism which reduces the number of tolerances required for printhead alignment in an ink jet printer.

SUMMARY OF THE INVENTION

The foregoing and other needs are provided by an improved ink jet printer ink cartridge body. The ink cartridge body is removably mountable in a printer carriage area of an ink jet printer. The printer carriage area includes at least first and second spaced-apart elongate guide rails. The ink cartridge body is provided by a molded or cast structure having an open-ended cavity therein for slidably engaging at least one ink cartridge. At least one printhead is fixedly attached in a printhead location on the ink cartridge body opposite the open-ended cavity. A cartridge body translation mechanism is attached to the cartridge body for translating the cartridge body in the printer carriage area relative to the elongate guide rails. At least two bearing points are provided at predetermined locations on the ink cartridge body, each of the bearing points being disposed on the cartridge body for separately engaging at least one of the elongate guide rails for aligning and maintaining the printhead in a predetermined orientation relative to the print media in the printer.

This invention also provides a method for aligning at least one printhead of an ink jet printer. The method includes providing an ink cartridge body which is removably mountable in a printer carriage area of an ink jet printer. The ink cartridge body is a molded or cast structure having an open-ended cavity therein for slidably engaging at least one ink cartridge and contains at least one printhead fixedly attached in a printhead location on the ink cartridge body opposite the open-ended cavity. At least two bearing points are disposed at a first end and a second end of the ink cartridge body for locating the ink cartridge body relative to first and second spaced-apart elongate guide rails. The bearing points engage the first and second guide rails in the printer carrier area of the ink jet printer. A printhead translation mechanism is attached to the cartridge body. The bearing points are positioned on the elongate guide rails so that the ink cartridge body is substantially supported by the elongate guide rails and aligned relative to print media and the printhead translation mechanism is substantially unsupported by the elongate guide rails.

An advantage of the present invention includes substantially improved print quality which is effected by reducing the number of tolerances required to align the ink jet printheads with respect to the print media. Another advantage of the invention that the ink cartridge body itself is transported along the elongate guide rails with improved dynamic stability. Bearings on the cartridge body rather than the carrier provide dynamic alignment of the printheads in the printer while the cartridge body is being translated along the length of the elongate guide rails. An important feature of the invention is the elimination of a conventional carrier which contains alignment tolerances to which a printhead body is attached. Instead of a carrier being attached to and aligned with the elongate guide rails, the printhead body itself is in direct contact with and aligned relative to the guide rails. The carrier, which is attached to the printhead body, is substantially unsupported by the guide rails. "Substantially unsupported" means that carrier contains no bearing surfaces or other surfaces in direct contact with the guide rails.

BRIEF DESCRIPTION OF THE DRAWINGS

Further advantages of the invention will become apparent by reference to the detailed description of preferred embodiments when considered in conjunction with the drawings, which are not to scale, wherein like reference characters designate like or similar elements throughout the several drawings as follows.

DETAILED DESCRIPTION OF THE PREFERRED EMBODIMENTS

Figure 1:
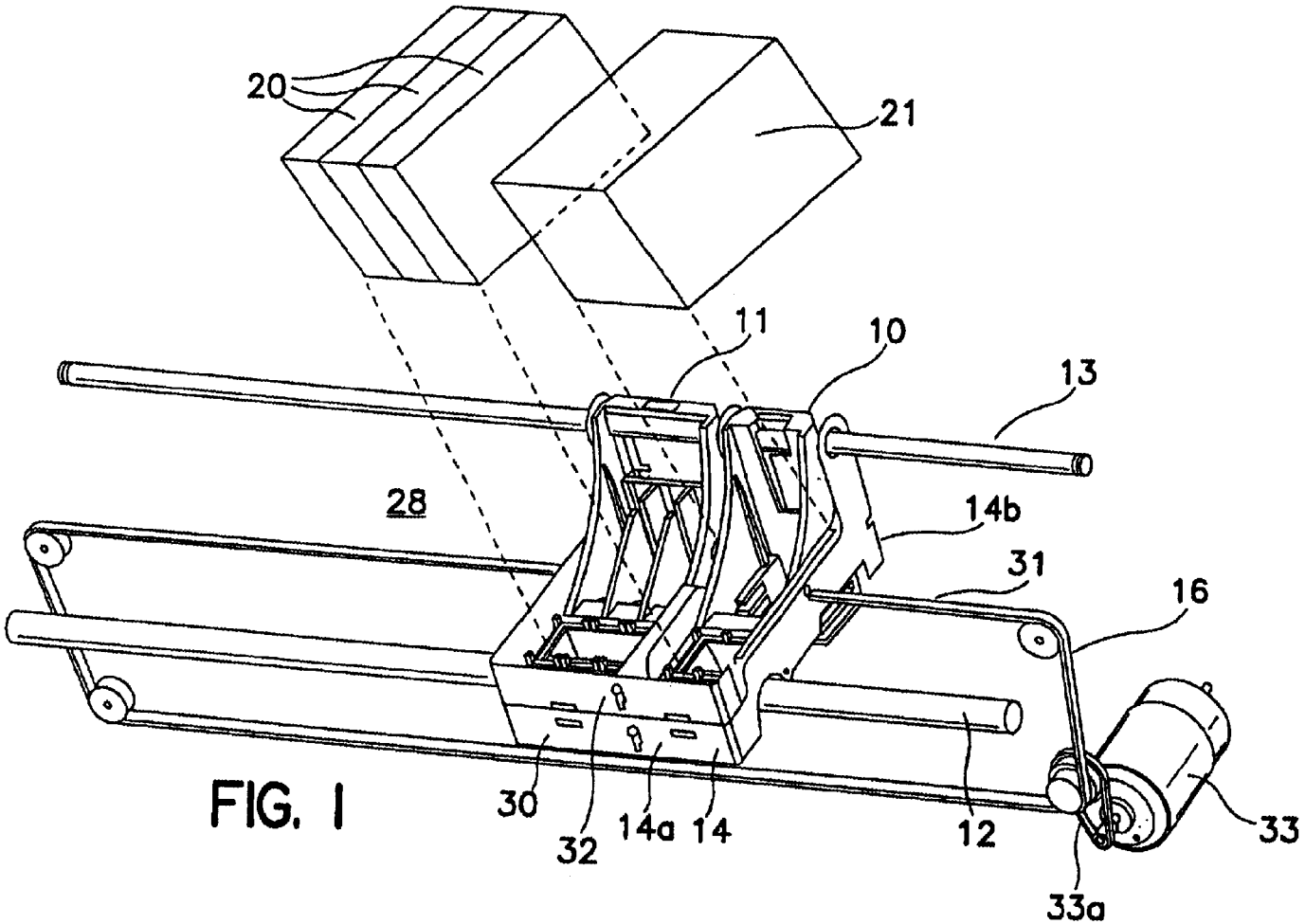
FIG. 1 is a perspective view of a portion of an ink jet printer according to the present invention.

Referring to FIG. 1, a portion of an ink jet printer is shown. The ink jet printer includes a number of operational components, a number of which will be described in detail, according to the present invention. The ink jet printer components include at least one ink cartridge body 10, at least two elongate guide rails 12 and 13, a translation mechanism including a printhead carrier 14 and a translation device 16, as described in detail below.

Figure 2:
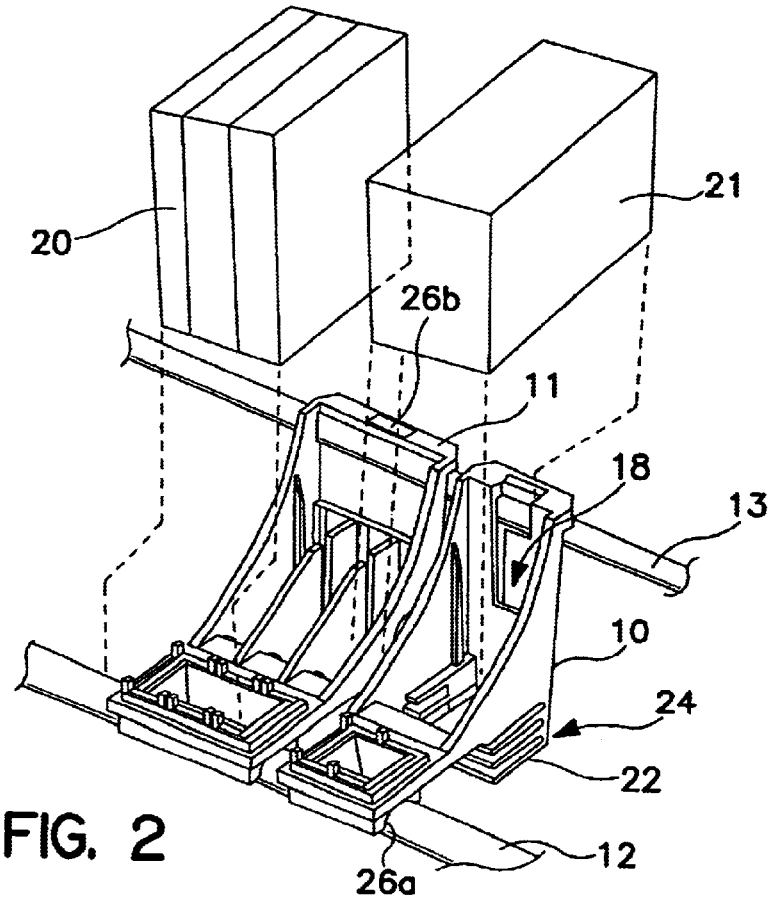
FIG. 2 is perspective view of an ink cartridge body and guide rail configuration according to the present invention.
Figure 3:
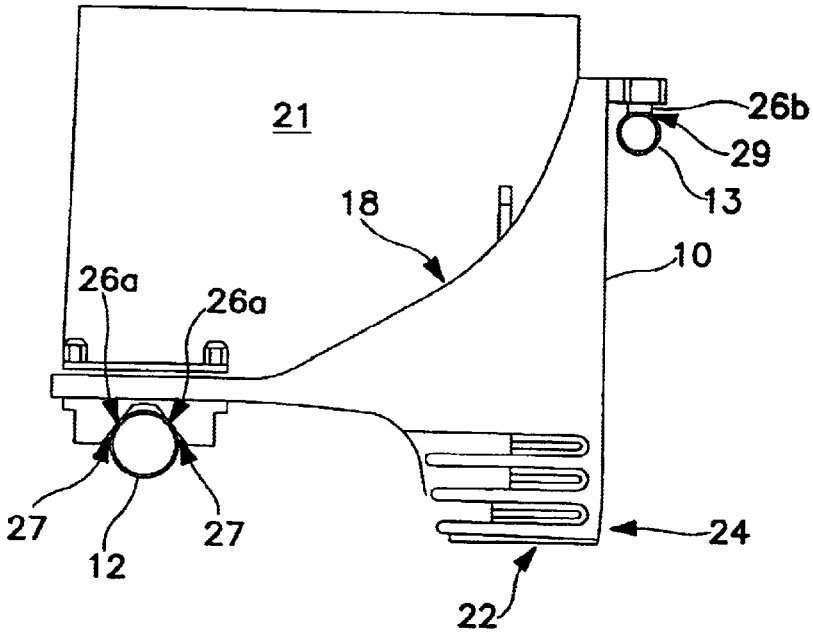
FIG. 3 is a side elevational view of an ink cartridge body and guide rail configuration according to the present invention.
Figure 4:
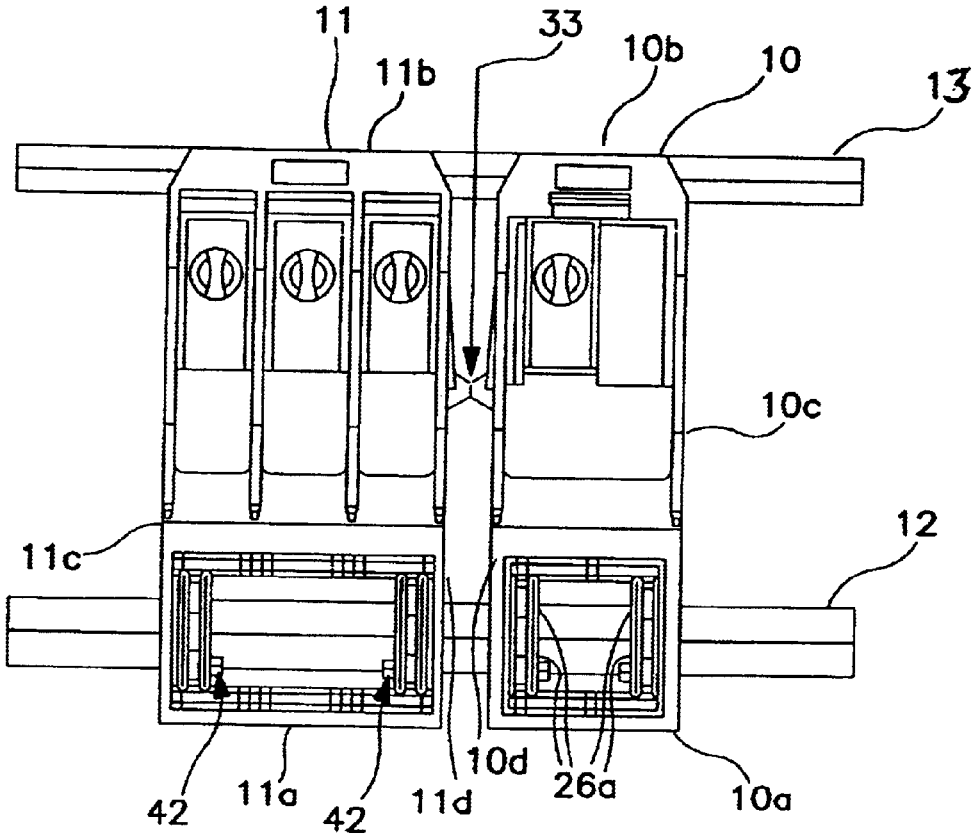
FIG. 4 is a top plan view of an ink cartridge body and guide rail configuration according to the present invention.

In a preferred embodiment of the present invention, as best shown in FIGS. 2–4, the ink jet printer includes at least one ink cartridge body 10 or 11. The ink cartridge body 10 or 11 is preferably a molded or cast structure. Accordingly, polymeric materials and castable metals, such as aluminum, zinc, magnesium and zinc/aluminum alloys may be used to fabricate ink cartridge body 10 or 11. Ink cartridge body 10 includes an open-ended cavity 18 positioned to receive at least one ink cartridge 21. Ink cartridges 21 is slidably engaged with and seated in cavity 18 of the ink cartridge body 10 whereby ink contained within the ink cartridge may be consumed during a printing operation. The ink cartridge body 10, according to the present invention may be adapted to contain color and/or monochrome ink cartridges 20 and 21.

The ink cartridge body 10 also includes at least one printhead 22 attached to the cartridge body 10 in a printhead location 24 opposite the open-ended cavity 18. The printhead 22 includes a plurality of nozzles and control circuitry for selectively expelling ink from the printhead 22 onto a print media, such as paper. As will be described in detail below, the ink cartridge body 10 further includes at least two bearing points 26*a* and 26*b*, selectively located at predetermined locations on the ink cartridge body 10 for aligning the printheads 22 relative to print media in a printer carriage area 28.

As best shown in FIG. 3, in a preferred embodiment of the present invention, the ink cartridge body 10 is supported and aligned in the ink jet printer by means of at least two bearing points 26*a* and 26*b*. The bearing points 26*a* and 26*b* slidably reside on the elongate guide rails 12 and 13. The bearing points 26*a* and 26*b* enable the ink cartridge body 10 to translate bidirectionally along a fixed length of the elongate guide rails 12 and 13 as the printhead 22 ejects ink from the nozzles onto the print media. The at least two bearing points 26*a* and 26*b* include a primary bearing point 26*a* aligned relative to a guiding surface 27 of the first elongate guide rail 12 and a secondary bearing point 26*b* aligned relative to a guiding surface 29 of the second elongate guide rail 13.

The elongate guide rails 12 and 13 are preferably elongate guide rods 12 and 13, which may have a substantially circular cross section, a substantially polygonal cross section, or a combination of circular and polygonal cross sections. Moreover, the elongate guide rails 12 and 13 may have a rectangular, oval, T-shaped, I-beam or U-shaped cross-sectional configuration. Alternatively, each elongate guide rail configuration may include a combination of any of the aforementioned cross-sectional configurations.

Furthermore, the elongate guide rails 12 and 13 are preferably spaced-apart and substantially parallel to one another and may be offset relative to one another or located at substantially the same elevation within the printer carriage area 28 of the printer. Guide rails 12 and 13 located at substantially the same elevation are shown with reference to FIG. 12 which is described in more detail below. Regardless of the guide rail orientation, it is preferred that axes defined by the elongate guide rails 12 and 13 be substantially parallel to one another. Providing substantially parallel elongate guide rails 12 and 13 helps in maintaining alignment of the printheads 22 in the printer. Use of two or more elongate guide rails reduces rotational tendencies of the ink cartridge body 10 in the printer. Additional anti-rotation devices such as wheels, guide bars and the like may be engaged with the cartridge body 10 to prevent rotation or jitter as the cartridge body 10 is translated along the elongate guide rails 12 and 13.

As best shown in FIG. 4, which is a top plan view of an ink cartridge body 10, the ink cartridge body 10 preferably has a generally rectangular configuration, having a first end 10*a*, second end 10*b*, first side 10*c* and second side 10*d*. In the configuration shown in FIG. 4, the primary bearing point 26*a* includes two bearing points 26*a* located proximate each side 10*c* and 10*d* of the ink cartridge body 10. Alternatively, the primary bearing point 26*a* may be formed as a unitary structure that spans the distance between the sides 10*c* and 10*d* located proximate the first end 10*a* of the ink cartridge body 10. Bearing point 26*a* is a single bearing point, or as shown in FIG. 3, bearing point 26*a* may be a dual contact bearing point which straddles elongate guide rail 12 on substantially opposing sides thereof. Bearing point 26*a* may also include contiguous contact with guide rail 12 as by use of a bearing sleeve attached to the first end 10*a* of the cartridge body 10. Other bearing points 26*a* may be used including but not limited to shoe bearings and the like for providing sliding contact and alignment between the cartridge body 10 and the guide rail 12.

The secondary bearing point 26*b* is preferably a unitary structure contacting the second elongate guide rail 13 on a top or guiding surface 29 thereof, preferably close to the apex of the guiding surface 29 of the second elongate guide rail 13. Preferably, the secondary bearing point 26*b* contacts the second elongate guide rail 13 at one location, as best shown in FIG. 3. However, in an alternative embodiment of the present invention the secondary bearing point 26*b* may also include a dual bearing point, a contiguous bearing or a shoe bearing which straddles elongate guide rail 13.

In a preferred embodiment of the present invention, the primary bearing point 26*a* includes a V-block datum pad, as best shown in FIG. 3. The V-block datum pad is manufactured to minimize movement in a direction perpendicular to the normal translational movement of the ink cartridge body 10 along the elongate guide rail 12. Furthermore, the V-block datum pad acts to minimize rotational movement of the ink cartridge body 10 relative to the elongate guide rails 12 and 13 as viewed from the perspective of FIG. 3.

As set forth above, an important aspect of the invention is that the ink cartridge body 10 is substantially supported and aligned directly to the elongate guide rails 12 and 13 via the primary bearing point 26*a* and the secondary bearing point 26*b*, rather than indirectly by aligning a printer carriage for holding an ink cartridge body and printheads as found in conventional ink jet printers. In a conventional ink jet printer the ink cartridge body and/or printhead is substantially supported by the carriage and also aligned thereto and the carriage is directly aligned and in contact with the guide rails. Correspondingly, there at least two sets of alignment tolerances associated with a conventional ink jet printer carriage and printhead, one between the carriage and guide rails and one between the printhead and the carriage.

According to the present invention, the ink cartridge body 10 is directly aligned to the elongate guide rails 12 and 13 through the use of the bearing points 26*a* and 26*b* provided on the ink cartridge body 10 rather than on the cartridge body carrier 14. Accordingly, the number of alignment tolerances normally required in conventional ink jet printers to produce quality images and text is proportionately reduced. Such a decrease in the number of operational tolerances leads to a more reliable high quality printer operation.

Moreover, the number of associated adjustments required to align the ink cartridge body 10 according to the present invention is reduced to a manageable level thereby reducing the cost and time needed to align the ink cartridge body 10 in the in the printer carriage area during printer manufacture. Since the ink cartridge body 10 contains one of the most important components of an ink jet printer, namely the printheads 22, it is tantamount that the ink cartridge body 10 be properly aligned relative to the print media in order to produce a print quality acceptable with a consumer's expectations. Therefore, reducing the associated tolerances required to be met before printing should promote increased consumer satisfaction with the printer operation and the final printed product.

Referring again to FIG. 1, the ink jet printer according to the present invention includes a translation mechanism including an ink cartridge body carrier 14 and translation device 16 located in a printer carriage area 28 of the ink jet printer. The translation mechanism is adapted to convey the at least one ink cartridge body 10 along elongate guide rails 12 and 13 relative to print media. According to the present invention, the ink cartridge body 10 or 11 is conveyed along the elongate guide rails 12 and 13 by the translation mechanism in a direction that is substantially perpendicular to the directional movement of the print media.

The ink cartridge body carrier 14 shown in FIG. 1 is adapted to accommodate a monochrome ink cartridge body 10 and a color ink cartridge body 11. The color ink cartridge body 11 is preferably adapted to engage up to three color ink cartridges 20, whereas the monochrome ink cartridge body 10 is preferably adapted to engage at least one monochrome ink cartridge 21. However, the ink cartridge body 11 could be adapted to engage more than three color cartridges and the ink cartridge body 10 could be adapted to engage more than one monochrome ink cartridge 21. It is particularly preferred that the ink cartridge body carrier 14 be releasably engaged with the at least one ink cartridge body 10 or 11. Accordingly, each ink cartridge body 10 or 11 may be readily separated from the ink cartridge body carrier 14 for routine maintenance of the printhead 22 components.

The translation device 16 of the translation mechanism preferably includes a belt 31 which is attached to the ink cartridge body carrier 14 and a motor 33 attached to the belt 31 for moving the ink cartridge body carrier 14 and attached ink cartridge body 10 or 11 bidirectionally along the axis defined by the guide rails 12 and 13 in a direction that is orthogonal relative to an incremental movement direction of the print media. As shown in FIG. 1, the belt 31 is preferably attached at the center of mass or center of friction of the ink cartridge body carrier 14 and ink cartridge body 10 assembly. The belt 31 of the translation device 16 is preferably maintained under tension when the ink jet printer is in a printing mode by tensioning device 33*a*. Further description of the translation mechanism is provided below.

The ink cartridge body carrier 14 according to the invention has a first end 14*a* and a second end 14*b* and is located in the printer carriage area 28 of the ink jet printer. The ink cartridge body carrier 14 also includes a biasing mechanism, described below, for biasing the first end 14*a* and second end 14*b* of the ink cartridge body carrier 14 away from the first and second elongate guide rails 12 and 13 when the cartridge body carrier 14 is removably attached to the ink cartridge body 10 or 11. By biasing the ink cartridge body carrier 14 away from the elongate guide rails 12 and 13, tolerances associated with traditional carriages which provide printhead alignment are subsumed into the ink cartridge body 10 alignment tolerances directly, thereby reducing the tolerance requirements of the printheads 22.

The biasing mechanism includes a number of associated components which cooperate to bias the ink cartridge body carrier 14 away from the elongate guide rails 12 and 13. Referring to FIGS. 5–11, a first embodiment of the biasing mechanism will be described. For a dual ink cartridge body carrier 14 embodiment, as described above with reference to FIG. 1, the ink cartridge body carrier 14 includes a first carrier portion 30 and a second carrier portion 32. Biasing mechanisms are included for each carrier portion 30 and 32 and ink cartridge body 10 or 11, respectively to removably attach the carrier portions 30 and 32 to the cartridge body 10 or 11 and to bias the carrier portions 30 and 32 away from the elongate guide rails 12 and 13.

Figure 6:
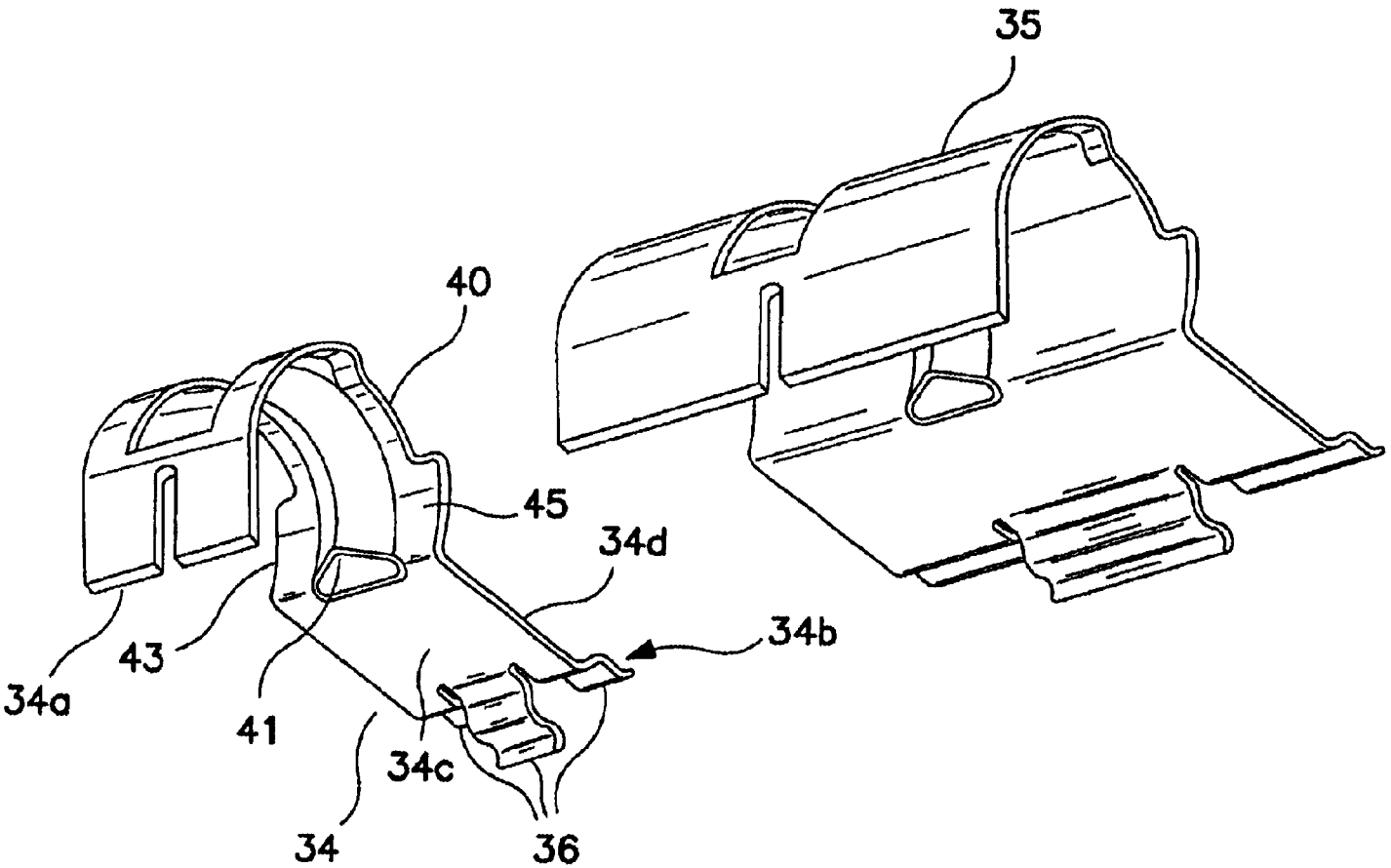
FIG. 6 is a perspective view of a latch according to the present invention.

In a preferred embodiment of the present invention, as best shown in FIGS. 1 and 6, the ink cartridge body carrier 14 includes a first carrier portion 30 and a second carrier portion 32. The first carrier portion 30 and second carrier portion 32 are constructed to mate in a complimentary manner allowing the first ink cartridge body 10 and a second ink cartridge body 11 to operate independently, as described further below. Preferably, the first carrier portion 30 releasably accommodates a first ink cartridge body 10 having at least one printhead 22 located in a printhead 22 location of the ink cartridge body 10. 'Releasably accommodates' means that the ink cartridge body carrier portions 30 and 32 are each attached to a respective ink cartridge body 10 and 11, and the ink cartridge bodies 10 and 11 may be separated from each carrier portion 30 and 32 at the operators convenience. On some occasions the printheads 22 may need cleaning or maintenance or the related circuit components may require maintenance and the ease to which the ink cartridge body carrier portions 30 and 32 may be separated from the ink cartridge bodies 10 and 11, allows for routine maintenance of these components. Furthermore, because each cartridge body 10 and 11 is accommodated by a respective carrier portion 30 and 32, each ink cartridge body 10 and 11 may be maintained without having to affect the operation of the other ink cartridge body, respectively. In a preferred embodiment the first ink cartridge body 10 releasably maintains a monochrome ink cartridge 21.

Figure 12:
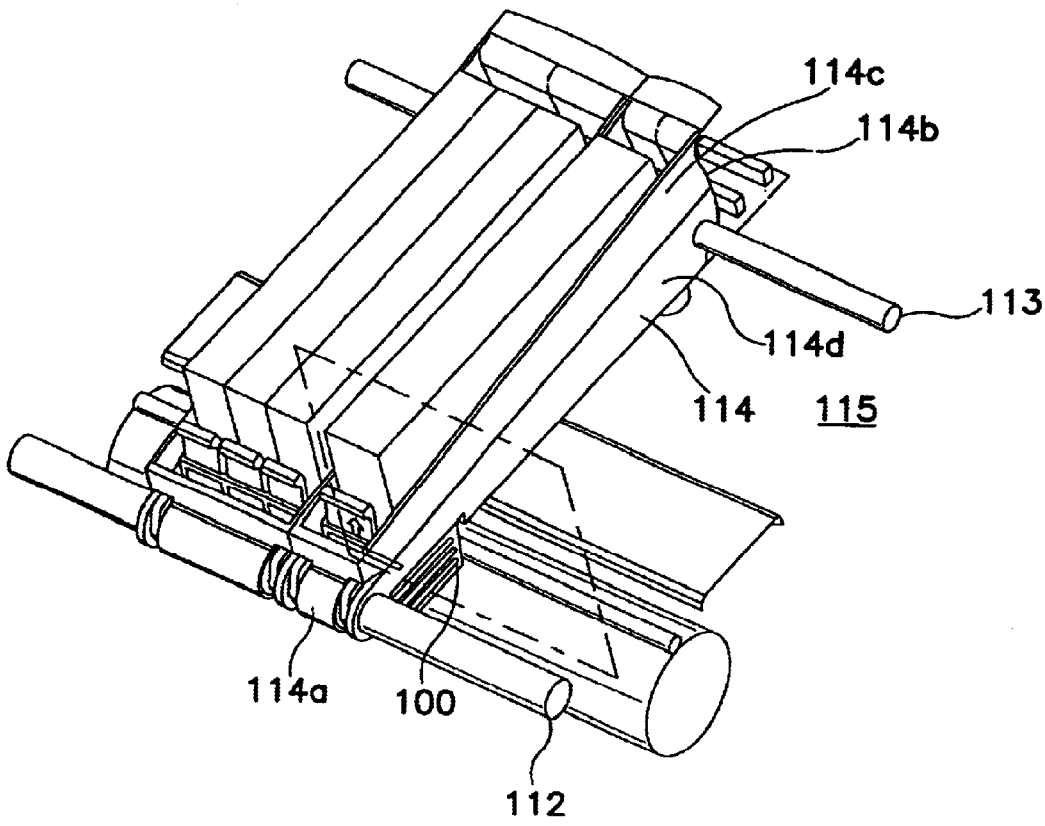
FIG. 12 is a perspective view of an alternative embodiment of the present invention.

The second carrier portion 32 releasably accommodates a second ink cartridge body 11 also having at least one printhead located in a printhead location of the ink cartridge body 11. 'Releasably accommodates' herein refers to the above description. Preferably, the second ink cartridge body 11 releasably maintains at least one color ink cartridge 20, and preferably three ink cartridges 20 associated with three printheads. According to the present invention, the carrier may be fabricated from sheet metal or injection molded thermoplastic or a combination thereof. Preferably, each carrier portion 30 and 32 includes a respective latch 34 and 35 for each ink cartridge body 10 and 11. This is also the case for the alternative embodiment as shown in FIG. 12.

Preferably, the first carrier portion 30 and the second carrier portion 32 are positioned relative to one another to independently move their respective cartridge bodies 10 and 11 relative to the elongate guide rails 12 and 13. These two carrier 14 portions 30 and 32 are uniquely constructed so that when a first ink cartridge body 10 and a second ink cartridge body 11 (such as a color and monochrome ink cartridge bodies) are attached to the ink cartridge body carrier 14, forces influencing one ink cartridge body 11 will not overwhelm the operational characteristics of the other cartridge body 10, more specifically, the printhead 22 operation.

Typically a color ink cartridge body 11 will include a greater amount of electrical connections than a monochrome ink cartridge body 10. When the color ink cartridge body 11 is seated onto the ink cartridge body carrier 14, a resultant force will exist between the ink cartridge body 11 and carrier 14 as a result of the connection of the electrical contacts located on the ink cartridge body 11 and the ink cartridge body carrier 14 and similarly for the ink cartridge body 10. Accordingly, if the ink cartridge body carrier 14 was not divided into a first carrier portion 30 and second carrier portion 32, resultant forces from one ink cartridge body could possibly overwhelm the operating characteristics of the other ink cartridge body, resulting in a deteriorated printed image. According to the present invention, this independent carrier 14 feature is important for producing a quality print image when using a dual ink cartridge body assembly.

Referring to FIG. 1, a translation mechanism including the carrier portions 30 and 32 and translation device 16 is attached to the ink cartridge bodies 10 and 11 to bi-directionally translate the ink cartridge bodies 10 and 11 in a direction orthogonal relative to the incremental movement of the print media. Preferably, the belt 31 of the translation device 16 is attached to the respective carrier portions 30 and 32. Preferably the belt 31 is under tension when the ink jet printer is in a printing mode. Referring to FIGS. 1 and 4, using a belt 31 under tension allows the biasing of the two ink cartridge bodies 10 and 11 together at a specific locating feature or biasing means 33 on each ink cartridge body 10 and 11, respectively.

The belt 31 and biasing means 33 are preferably attached to the ink cartridge body carrier 14 at the center of mass and/or the center of friction of the entire ink cartridge body 10 and carrier 14 assembly. Since the belt 31 is attached to respective ink cartridge body carrier portions 30 and 32, each ink cartridge 10 and 11 may be described as translating across the print media independently.

For example, for a monochrome/color ink cartridge body 10 and 11 arrangement as shown in FIG. 1, when the monochrome ink cartridge body 10 is furthest away from the carrier belt 31 attachment point that is being pulled, the monochrome ink cartridge body 10 is being pulled along the elongate guide rods 12 and 13 while pushing the color ink cartridge body 11 at the biasing means 33 location. Correspondingly, when the ink cartridge body carrier 14 begins traveling in the opposite direction, the color ink cartridge body 11 is the furthest ink cartridge body away from the respective carrier belt 31 attachment point and is being pulled along the elongate guide rails 12 and 13 while the monochrome ink cartridge body 10 is being pushed along by the color ink cartridge body 11 at the biasing means 33 location. This push/pull action prevents a gap from occurring between the ink cartridge bodies 10 and 11 during acceleration of the translation mechanism during a printing operation. By maintaining the ink cartridge bodies 10 and 11 at fixed locations relative to one another by the tensioned belt 31 and biasing means 33 location as they translate back and forth along the elongate guide rails 12 and 13, the translation mechanism tends to ensure that an accurate image is printed.

During printer operation, the belt 31 will essentially always be under tension which helps to insure biasing of the ink cartridge bodies 10 and 11 together in order to maintain a precise distance between the printhead 22 from the monochrome ink cartridge body 10 to the color ink cartridge body 11. The tensioned carrier belt 31 further helps to provide good dynamic stability when the ink cartridge body carrier 14 is moving relative to the print media. The belt 31 tension may be temporarily relieved in order for easy insertion or extraction of the ink cartridge bodies 10 and 11 from the ink cartridge body carrier 14. When the belt 31 is under tension release, the ink cartridge body carrier portions 30 and 32 will have some allowable relative motion with respect to one another. Preferably the relative motion is between about 1 mm and about 2 mm, but the motion is not limited to this amount.

The biasing means 33 maintains a predetermined spatial relationship between the first ink cartridge body 10 and the second ink cartridge body 11. As best shown in FIG. 4, for a dual ink cartridge body assembly the biasing means 33 is positioned on a complimentary surface of each individual ink cartridge body 10 and 11. More specifically, the biasing means is located on a surface 10*d* of the ink cartridge body 10 which faces or opposes surface 11*d* of the other ink cartridge body 11. The biasing means 33 implementation coupled with the independent action permitted between the first carrier portion 30 and second carrier portion 32 permit the printhead 22 to print a high quality image without the numerous operational tolerances associated with conventional ink cartridge body carrier assemblies.

Figure 7:
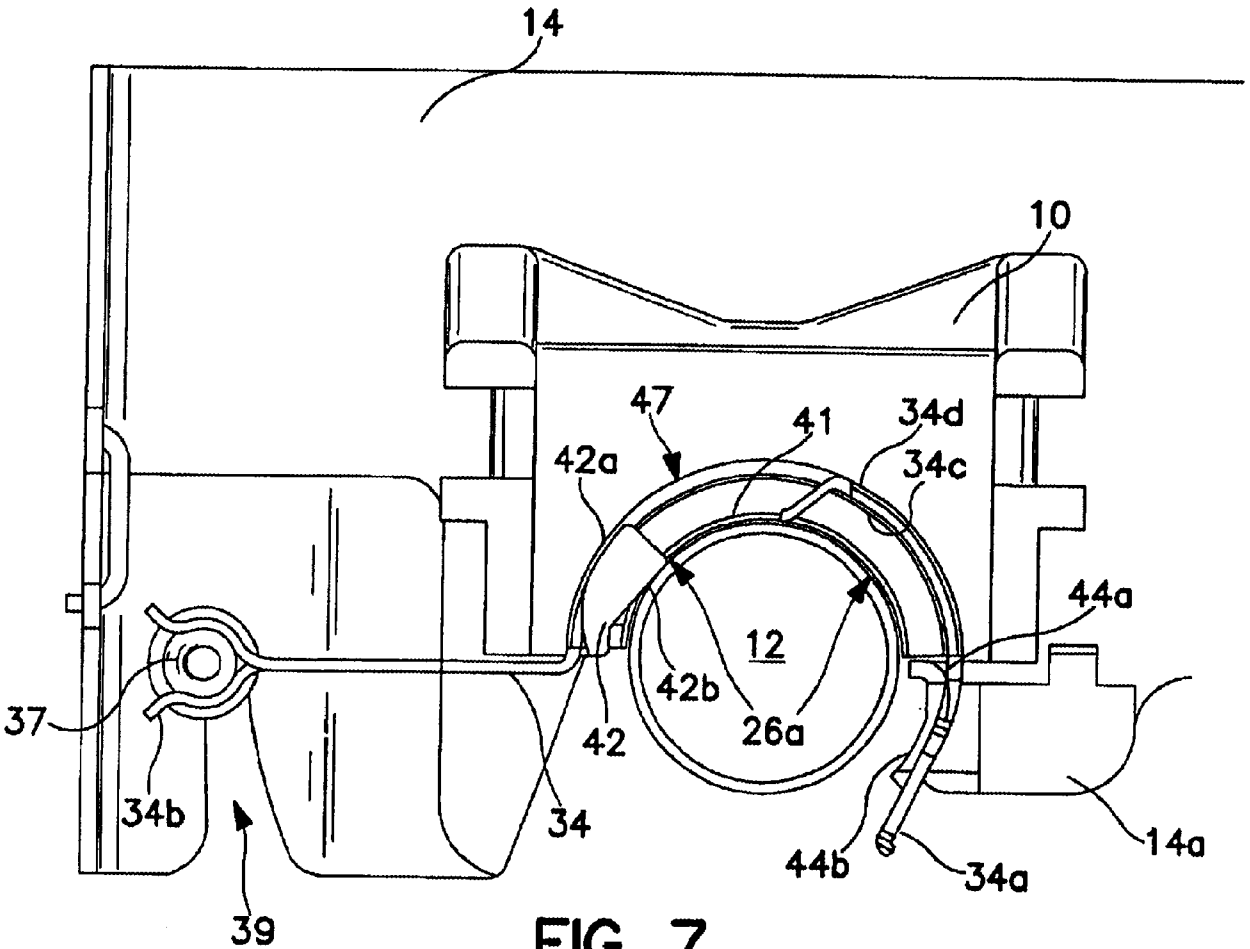
FIG. 7 is a cross-sectional view of a biasing mechanism according to the present invention.
Figure 8:
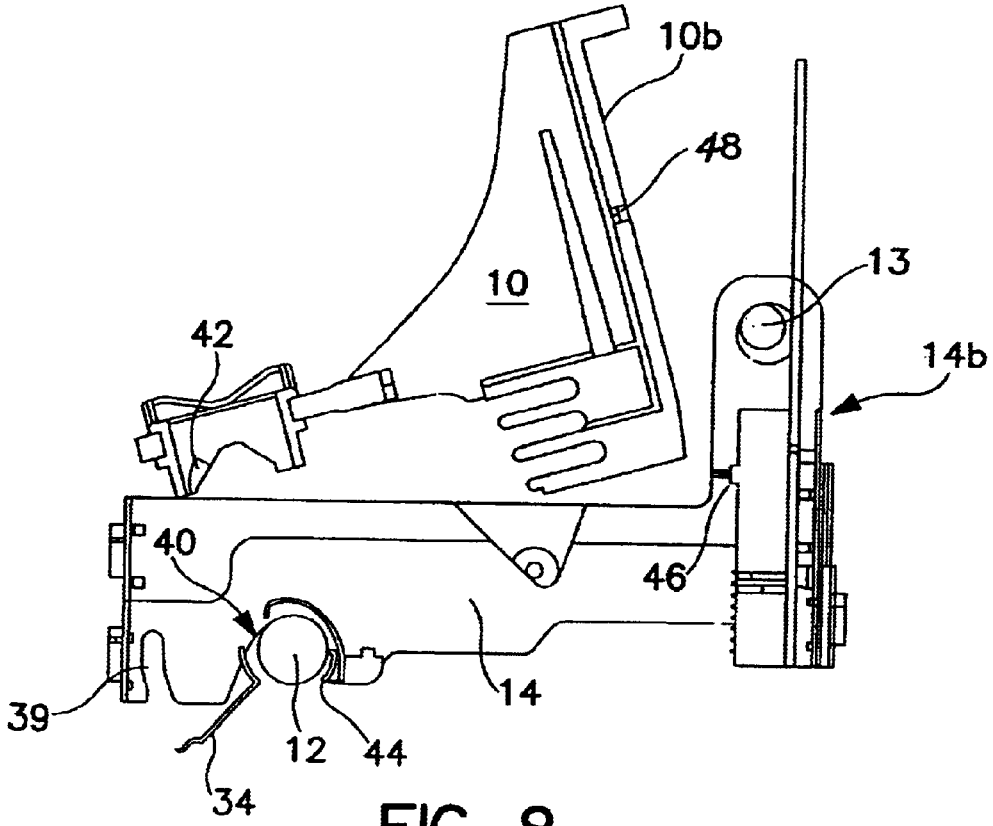
FIG. 8 is a side elevational view of an ink cartridge body being inserted into an ink cartridge body carrier according to the present invention.

As described above, the carrier 14 is biased away from guide rails 12 and 13 when the carrier 14 is attached to the cartridge bodies 10 and 11. The biasing mechanisms include latches 34 and 35 shown in detail in FIG. 6. The important features of latches 34 and 35 are substantially the same. Accordingly, only one of the latches 34 or 35 will be described in detail. Latch 34 includes first end 34*a*, second end 34*b*, a first surface 34*c* and a second surface 34*d*. The second end 34*b* of the latch 34 includes a flange set 36 for receiving a shaft 37 (FIG. 5) which is used to move the latch 34 to a latching position when the shaft 37 is disposed in recess 39 in carrier portions 30 and 32. Recess 39 is a generally arcuate recess or opening in carrier portions 30 and 32 which enables shaft 37 to be moved in an arcuate path thereby rotating latch 34 around elongate guide rail 12. Clockwise rotation of latch 34, as viewed from the perspective of FIG. 7, removably connects the carrier portion 32 to the ink cartridge body 10. Reverse movement of shaft 37 causes a reverse rotation of latch 34 about the elongate guide rail 12. Latch 34 also contains a rib portion 41 and at least one and preferably two recessed portions 43 and 45 on opposing sides of rib portion 41. As shown in FIG. 7, the rib portion 41 of latch 34 is closely adjacent to the elongate guide rail 12 whereas recessed portions 43 and 45 are closely adjacent a portion 47 of the ink cartridge body 10.

Figure 5:
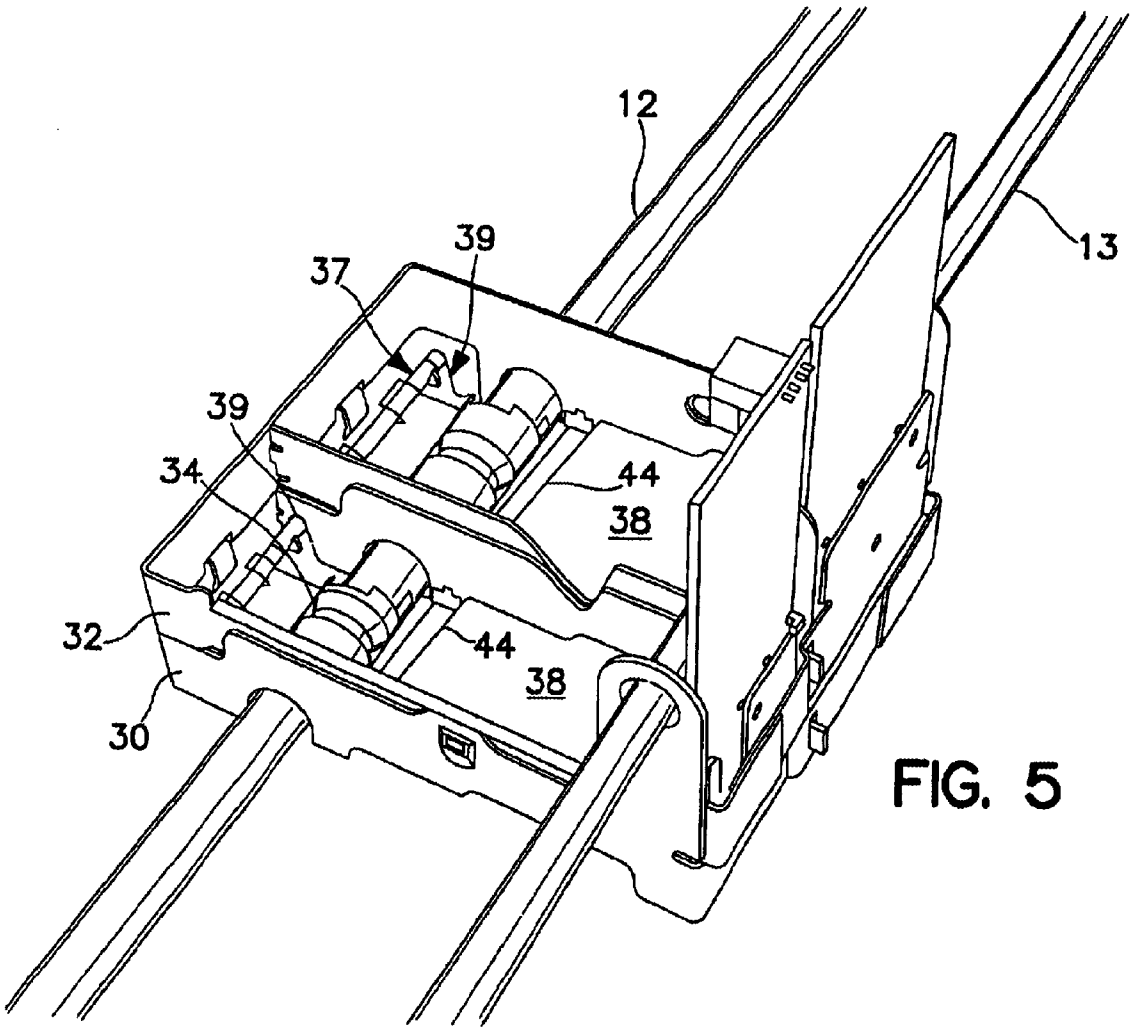
FIG. 5 is a perspective view of an ink cartridge body carrier assembly according to the present invention.

As shown in FIGS. 5, 6 and 7, latch 34 is disposed on the first elongate guide rail 12 in an open area 38 of the ink cartridge body carrier portions 30 and 32. Latch 34 preferably has a width dimension which closely corresponds to a width dimension between bearing points 26*a* on the ink cartridge body 10. Correspondingly, the width of latch 34 coupled with the cut outs 40 are designed to accommodate the first latch member 42 (FIGS. 4 and 6).

Referring to FIGS. 6–11, the latch 34 includes at least one and preferably two cutouts 40 for receiving the first latch member 42 (FIGS. 4 and 7) located on the ink cartridge body 10 adjacent to the primary bearing point 26*a*. The first latch member 42 includes a top surface 42*a* and a lower surface 42*b*. In a preferred embodiment, the latch member 42 preferably has a substantially tabular shape so that it extends only partway between bearing points 26*a* (FIG. 4). A first biasing member 44 (FIGS. 5 and 7) having first and second opposing surfaces 44*a* and 44*b* is provided on an opposing side of elongate guide rail 12 from shaft 37 (FIG. 7) and is attached to the carrier portions 30 and 32 in open areas 38 thereof.

Figure 9:
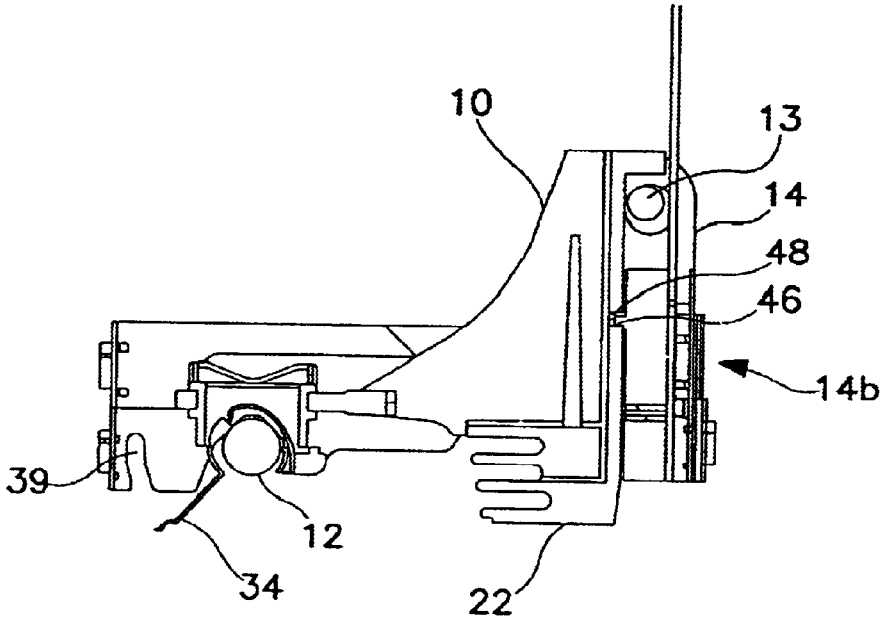
FIG. 9 is a side elevational view of an ink cartridge body seated in an ink cartridge body carrier according to the present invention.
Figure 10:
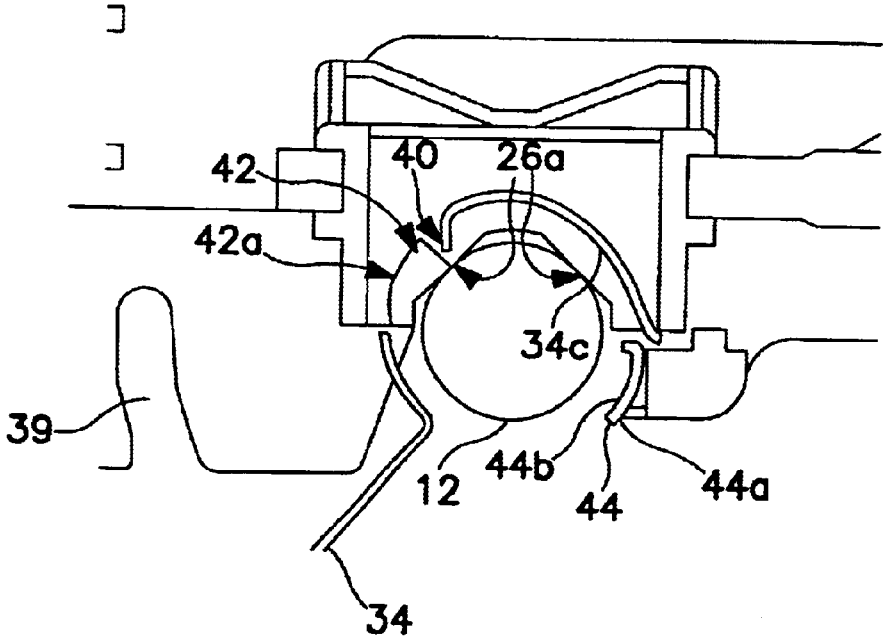
FIG. 10 is a partial side elevational view of a biasing mechanism in an unbiased orientation according to the present invention.
Figure 11:
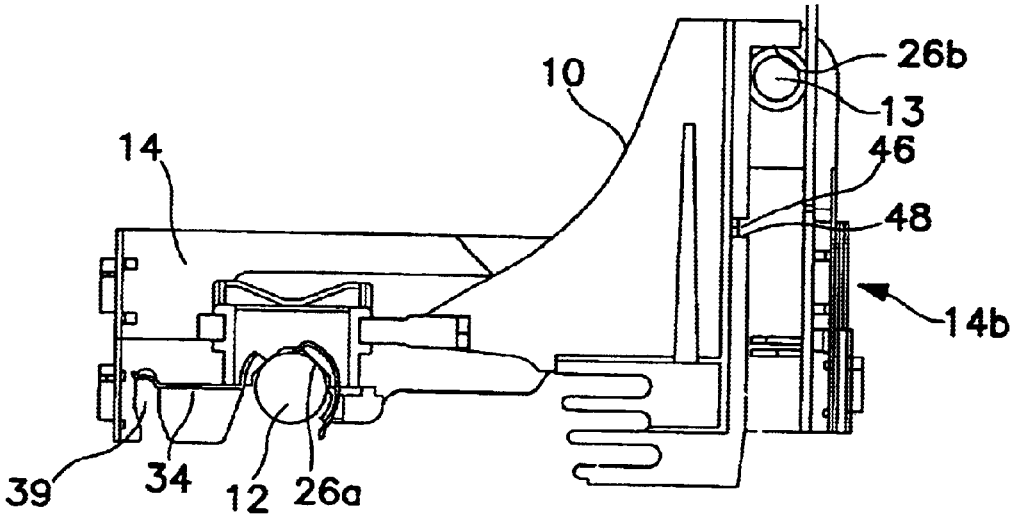
FIG. 11 is a side elevational view of an ink cartridge body seated in an ink cartridge body carrier with a biasing mechanism latched according to the present invention.

Referring to FIGS. 9–11, a sequence for attaching and aligning an ink cartridge body 10 in an ink jet printer carriage area 28 is described. FIG. 9 illustrates orientation of an ink cartridge body 10 with respect to a carrier 14 at the beginning of the attaching sequence. As shown, the ink cartridge body carrier 14 is resting on the elongate guide rails 12 and 13 before the ink cartridge body 10 is attached to the ink cartridge body carrier 14. FIG. 10 illustrates the ink cartridge body 10 having bearing points 26*a* seated with respect to elongate guide rails 12 and 13 with latch 34 in an unlatched orientation, wherein the ink cartridge body carrier 14 remains in contact with the elongate guide rails 12 and 13. When bearing points 26*a* and 26*b* of the ink cartridge body 10 are seated on the elongate guide rails 12 and 13, the bearing points 26*a* and 26*b* are substantially supporting the weight of the ink cartridge body 10.

As shown in FIG. 10, latch member 42 is disposed in cutouts 40 of the latch 34. As the latch 34 is rotated from the unlatched to the latched position, the first end 34*a* (FIG. 7) circumvents the top surface 42*a* of the first latch member 42 and also captures the first biasing member 44, thereby fixedly attaching the ink cartridge body 10 and ink cartridge body carrier 14 to one another. The first surface 34*c* of the latch 34 in recessed portion 43 and 45 thereof acts against the top surface 42*a* of the first latch member 42 to secure the primary bearing points 26*a* to the first elongate guide rail 12 (FIG. 11). In the latched position, the shaft 37 resides in an upper portion of the recess 39 (FIG. 7).

Referring again to FIGS. 8, 9, and 11, a second biasing member 46 is preferably located at the second end 14*b* of the ink cartridge body carrier 14 for upwardly engaging a second latch member 48 located on the second end 10*b* of the ink cartridge body 10. As the first end 34*a* of the latch 34 passes around the first biasing member 44 the first surface 34*c* of the latch 34 engages the top surface 44*a* of the first biasing member 44 applying a resultant force to the first biasing member 44 which lifts the ink cartridge body carrier 14 off of the first elongate guide rail 12. The forcing action also forces the second biasing member 46 into engagement with the second latch member 48 thereby biasing the ink cartridge body carrier 14 away from a second elongate guide rail 13, as shown in FIG. 11. Consequently, when the latch 34 engages latch member 42 and biasing member 44, and latch member 48 engages biasing member 46, the ink cartridge body 10 is substantially supported and aligned by the bearing points 26*a* and 26*b* relative to the first and second elongate guide rails 12 and 13. Furthermore, by the above action, the ink cartridge body carrier 14 is substantially unsupported by the elongate guide rails 12 and 13.

Referring to FIGS. 12–17, an alternative embodiment of the present invention is shown. According to the alternative embodiment of the invention, an ink cartridge body 100 is disposed upon elongate guide rails 112 and 113. A translation mechanism comprising an ink cartridge body carrier 114 is provided for translational movement of the ink cartridge body 100 in the carriage area 115. The cartridge body carrier 114 also includes a biasing mechanism for biasing the ink cartridge body carrier 114 away from the first and second elongate guide rails 112 and 113. The ink cartridge body carrier 114 is biased away from elongate guide rails 112 and 113, so that the ink cartridge body 100 is substantially supported and aligned to the elongate guide rails 112 and 113 by a primary bearing point 116*a* and a secondary bearing point 116*b*.

Figure 16:
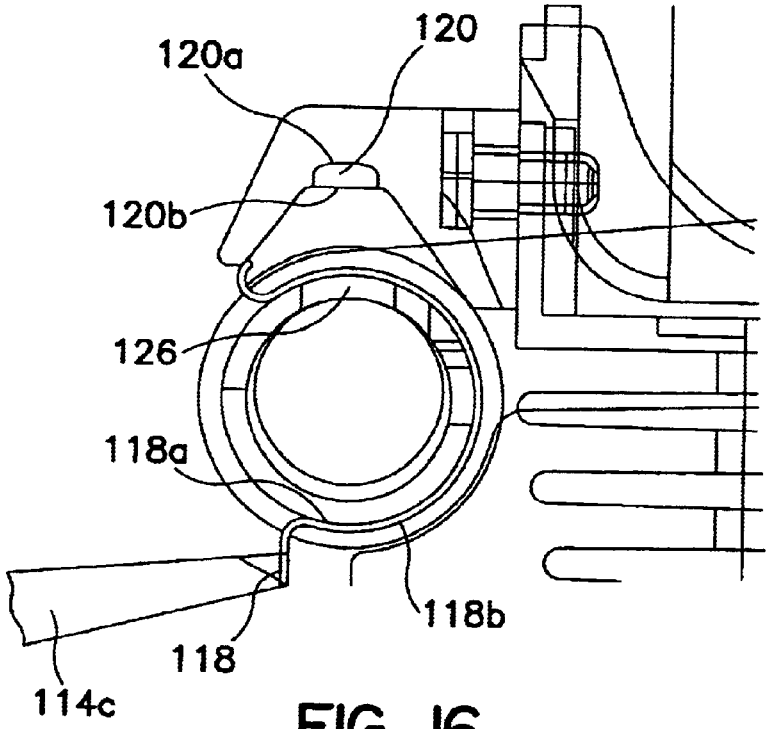
FIG. 16 is a partial side elevational view of a biasing mechanism in an unbiased orientation according to an alternative embodiment of the present invention.
Figure 17:
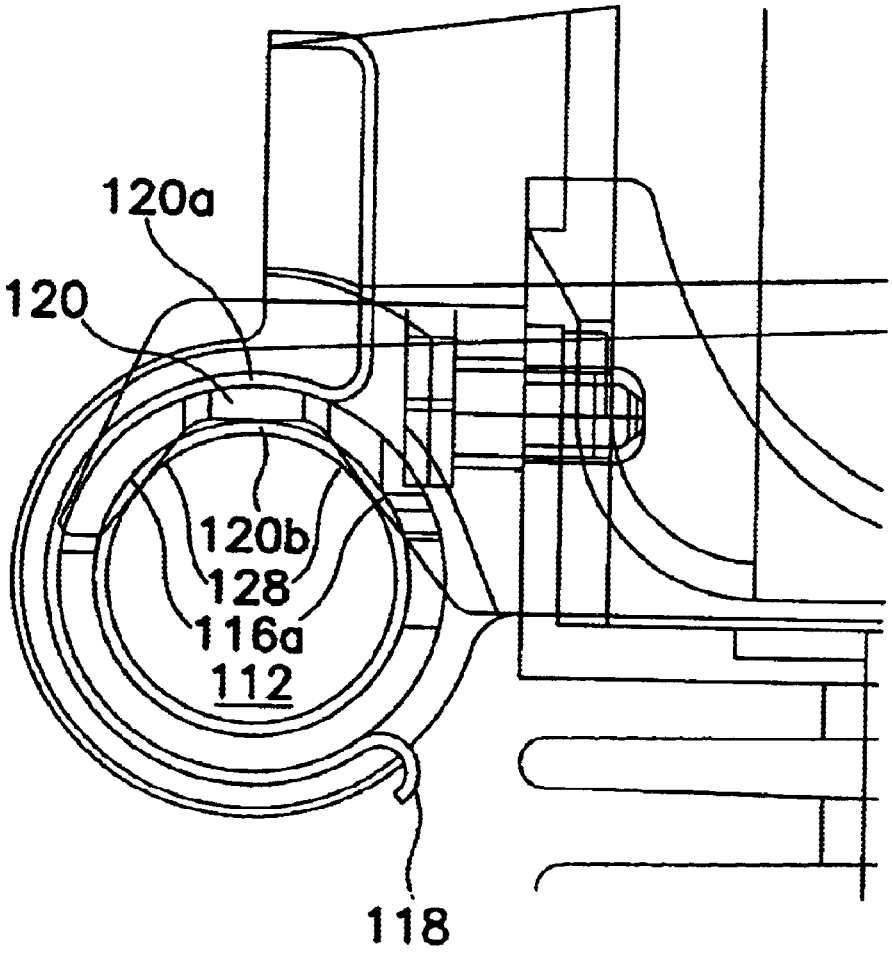
FIG. 17 is a partial side elevational view of a biasing mechanism in a biased orientation according to an alternative embodiment of the present invention.

Referring to FIGS. 16 and 17, the biasing mechanism includes a latch 118 having a bottom surface 118*a* and a top surface 118*b*. The latch 118 is disposed proximate the first end 114*a* of the ink cartridge body carrier 114. The latch 118 rotates to engage a first latching member 120 having a top surface 120*a* and a bottom surface 120*b*. The latching member 120 is adjacently located to a first bearing point 116*a* of the ink cartridge body 100.

A biasing member 122 located on the second end 114*b* of the ink cartridge body carrier 114 is positioned to engage a second latching member 124 located on the second end 100*b* of the ink cartridge body 100. The second latching member 124 is preferably disposed on an opposing surface from the secondary bearing point 116*b*. However, the second latching member 124 and the secondary bearing point 116*b* may alternatively be included as a unitary member or as separate members.

Figure 13:
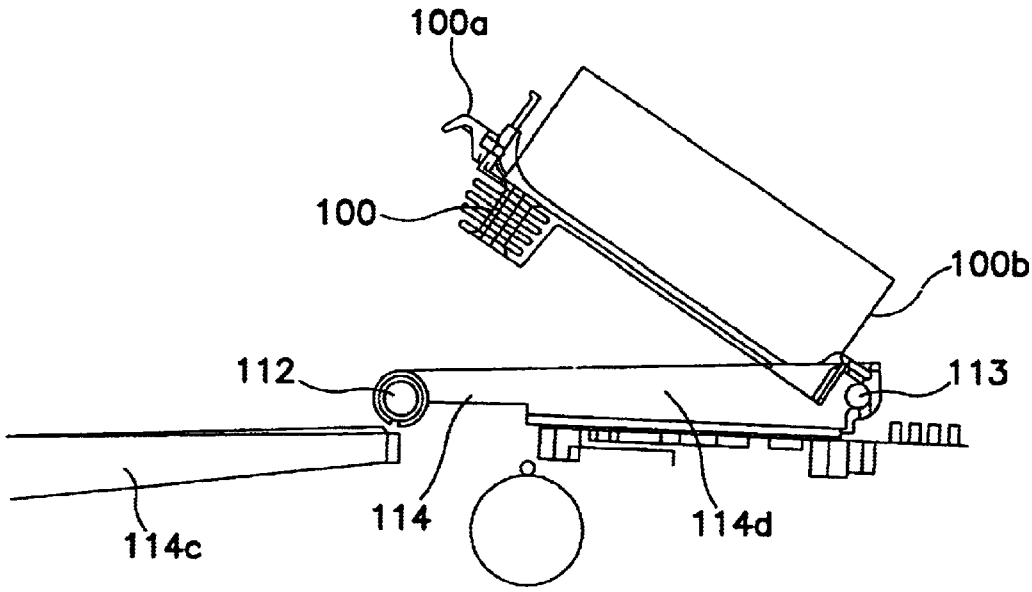
FIG. 13 is a side elevational view of an ink cartridge body being inserted into an ink cartridge body carrier according to an alternative embodiment of the present invention.
Figure 14:
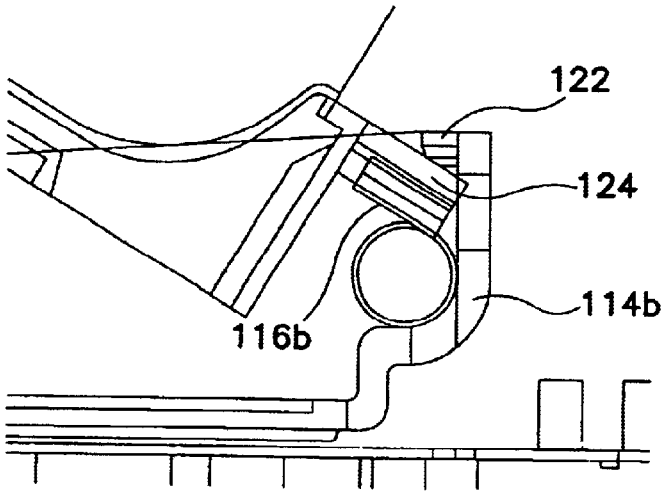
FIG. 14 is a partial side elevational view of a biasing mechanism according to an alternative embodiment of the present invention.
Figure 15:
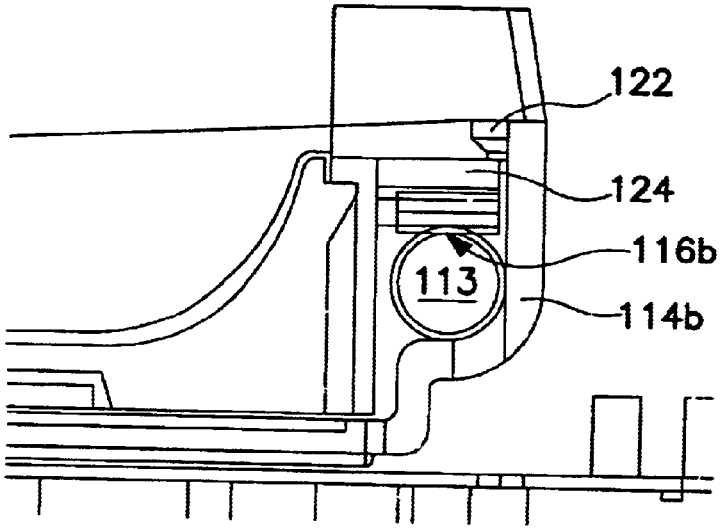
FIG. 15 is a partial side elevational view of a biasing mechanism according to an alternative embodiment of the present invention.

As shown in FIGS. 13 and 14, the ink cartridge body carrier 114 is attached to the ink cartridge body 100 in the alternative embodiment by first engaging the second latching member 124 with the biasing member 122. As first end 100*a* of the ink cartridge body 100 rotates towards the ink cartridge body carrier 114, the upward force exerted by the second latching member 124 to the biasing member 122 urges the second end 114*b* of the ink cartridge body carrier 114 away from the second elongate guide rail 113 (FIG. 15). The urging of the second end 114*b* of the ink cartridge body carrier 114 away from the second elongate guide rail 113 differs from the above-described first embodiment of the invention. In the first embodiment described above, engagement of the secondary latch member 48 and secondary biasing member 46 occurs automatically when the first latch member 42 and the first biasing member 44 engage the rotatable latch 34.

As the second end 100*b* of ink cartridge body 100 rotates around the guide rail 113 and into the ink cartridge body carrier 114, the first latching member 120 is preferably inserted into a recess 126 adjacently located to the first end 114*a* of the ink cartridge body carrier 114. Once the primary bearing points 116*a* reside on the bearing surface 128 of the first elongate guide rail 112, the latch 118 is rotated in a clockwise direction (FIGS. 12, 13 and 17) to secure the primary bearing points 116*a* relative to the bearing surface 128 and also for biasing the ink cartridge body carrier 114 away from the first and second elongate guide rails 112 and 113.

The latch 118 engages the first latching member 120 which now resides in recess 126, by rotating the first portion 114*c* of the ink cartridge body carrier 114 towards the second end 114*b*. As the first portion 114*c* rotates around the first elongate guide rail 112, the bottom surface 118*a* of the latch 118 contacts and circumvents the top surface 120*a* of the first latching member 120. The engagement of the bottom surface 118*a* of the latch 118 and the top surface 120*a* of the first latching member 120 actuates or biases the first portion 114*a* of the ink cartridge body carrier 114 away from the first elongate guide rail 112 (FIG. 17). Accordingly, the first latching member 120 may also be described as a biasing member due to the resulting function.

The ink cartridge body 100 is operational when the first portion 114*c* has rotated to be substantially adjacent or contacting the second portion 114*d* of the ink cartridge body carrier 114. Consequently, when the rotatable latch 118, first latching member 120, second latching member 124 and biasing member 122 are engaged, the ink cartridge body 100 is substantially supported and aligned by the first and second bearing points 116*a* and 116*b* relative to the first and second guide rails 112 and 113, respectively. Furthermore, the ink cartridge body carrier 114 is substantially unsupported by the elongate guide rails 112 and 113 when the latching and bearing members are engaged.

It is contemplated, and will be apparent to those skilled in the art from the preceding description and the accompanying drawings, that modifications and changes may be made in the embodiments of the invention. Accordingly, it is expressly intended that the foregoing description and the accompanying drawings are illustrative of preferred embodiments only, not limiting thereto, and that the true spirit and scope of the present invention be determined by reference to the appended claims.

What is claimed is:

1. An ink cartridge body which is removably mountable in a printer carriage area of an inkjet printer, the printer carriage area including at least first and second spaced-apart elongate guide rails, the ink cartridge body comprising:

a molded or cast structure having an open-ended cavity therein for slidably engaging at least one ink cartridge, at least one printhead fixedly attached in a printhead location on the ink cartridge body opposite the open-ended cavity, a cartridge body translation mechanism attached to the cartridge body for translating the cartridge body in the printer carriage area relative to the elongate guide rails, and at least one primary bearing point and at least one secondary bearing point at predetermined locations on the ink cartridge body, each of the primary and secondary bearing points disposed on the cartridge body for separately engaging at least one of the elongate guide rails for aligning and maintaining the printhead in a predetermined orientation relative to the print media in the printer and whereby the translation mechanism is substantially unsupported by the elongate guide rails.

2. The ink cartridge body of claim 1, further comprising a latching tab adjacent to the at least one primary bearing point for engaging a latching mechanism on an ink cartridge body carrier thereby maintaining the at least one primary bearing point in a predetermined alignment relative to the first elongate guide rail.

3. The ink cartridge body of claim 1, further comprising the at least one primary bearing point on the cartridge body adjacent the first elongate guide rail and the at least one secondary bearing point on the cartridge body adjacent the second elongate guide rail.

4. The ink cartridge body of claim 1, further comprising a biasing means located on an outer wall of the ink cartridge body for biasing the ink cartridge body relative to another ink cartridge body, thereby maintaining a predetermined spatial relationship between ink cartridge bodies.

5. The ink cartridge body of claim 1, wherein the ink cartridge body releasably engages at least one color ink cartridge.

6. The ink cartridge body of claim 1, wherein the ink cartridge body releasably engages a monochrome ink cartridge.

7. The ink cartridge body of claim 1, wherein the bearing points are predeterminedly located on the ink cartridge body to enable the ink cartridge body to contact a guiding surface of the elongate guide rails providing for translational movement along a length of the guide rails.

8. The ink cartridge body of claim 3, wherein the at least one primary bearing point comprises a V-block datum pad.

9. The ink cartridge body of claim 1, wherein the cartridge body translation mechanism comprises a carrier assembly removably attached to the cartridge body and a belt attached to the carrier assembly, the carrier assembly being devoid of bearing points for engaging the elongate guide rails.

10. A method for aligning at least one printhead of an ink jet printer in a printer carrier area, the method comprising the steps of:

providing an ink cartridge body which is removably mountable in a printer carriage area of an ink jet printer, the ink cartridge body comprising:

a molded or cast structure having an open-ended cavity therein for slidably engaging at least one ink cartridge, at least one printhead fixedly attached in a printhead location on the ink cartridge body opposite the open-ended cavity therein, and at least a first and a second bearing point disposed at a first end and a second end of the ink cartridge body for locating the ink cartridge body relative to first and second spaced-apart elongate guide rails and for engaging the first and second guide rails in the printer carrier area of the ink jet printer, attaching a printhead translation mechanism to the cartridge body; and positioning the bearing points of the ink cartridge body on the elongate guide rails so that the ink cartridge body is substantially supported by the elongate guide rails and aligned relative to print media and the printhead translation mechanism is substantially unsupported by the elongate guide rails.

11. The method for aligning at least one printhead of an ink jet printer according to claim 10, further comprising the step of latching the ink cartridge body to the printhead translation mechanism via a latch on the translation mechanism which rotatably engages a first latching member on the ink cartridge body thereby biasing the translation mechanism away from a first elongate guide rail, the translation mechanism providing for bidirectionally moving the ink cartridge body in a direction that is substantially orthogonal to an incremental movement direction of a recording medium.

12. The method for aligning at least one printhead of an ink jet printer according to claim 10, further comprising the step of latching the ink cartridge body to the printhead translation mechanism via a latch on the first elongate guide rail which rotatably engages a first latching member on the ink cartridge body, the translation mechanism further including a first biasing member operable to engage the rotating latch thereby biasing the translation mechanism away from the first elongate guide rail, the translation mechanism providing for bidirectionally moving the ink cartridge body in a direction that is substantially orthogonal to an incremental movement direction of a recording medium.

13. The method for aligning at least one printhead of an inkjet printer according to claim 11, further comprising the step of disposing the second bearing point of the ink cartridge body onto the second elongate guide rail, and engaging a second latching member to a biasing member located on the translation mechanism thereby biasing the translation mechanism away from the second elongate guide rail, the second bearing point thereby aligning the printhead relative to print media, wherein the latching and biasing members are operable to bias the translation mechanism away from the elongate guide rails so that the translation mechanism is substantially unsupported by the elongate guide rails and the ink cartridge body is substantially supported by the elongate guide rails.

14. The method for aligning at least one printhead of an ink jet printer according to claim 12, further comprising the step of disposing the second bearing point of the ink cartridge body onto the second elongate guide rail, the second bearing point for aligning the ink cartridge body relative to print media, the translation mechanism further including a second biasing member adjacent the second bearing point and operable to engage a second latching member on the ink cartridge body thereby biasing the translation mechanism away from the second elongate guide rail, the latching and biasing members operable to bias the translation mechanism away from the elongate guide rails so that the translation mechanism is substantially unsupported by the elongate guide rails and the ink cartridge body is substantially supported by the elongate guide rails.

15. A printhead translation mechanism having first and second ends located in a printer carriage area of an ink jet printer for bi-directionally moving at least one ink cartridge body across a print media orthogonal to the movement of the print media in the printer carriage area, the ink cartridge body including a printhead and at least a first and a second bearing point for aligning the printhead relative to first and second spaced-apart elongate guide rails and for translating the cartridge body and printhead along the first and second elongate guide rails, the printhead translation mechanism comprising a biasing device for biasing the translation mechanism away from the first and second elongate guide rails when the translation mechanism is removably attached to the ink cartridge body whereby the translation mechanism is substantially unsupported by the elongate guide rails.

16. The printhead translation mechanism of claim 15, wherein the biasing mechanism further comprises:

a latch disposed adjacent to the first elongate guide rail for rotatably engaging a first latch member located adjacent the first bearing point of the ink cartridge body, a first biasing member located proximate the first end of the printhead translation mechanism for engaging the latch and thereby biasing the translation mechanism away from the first elongate guide rail, a second biasing member located at a second end of the printhead translation mechanism for upwardly engaging a second latching member located on the ink cartridge body proximate thereto thereby biasing the translation mechanism away from a second elongate guide rail, and wherein when the latching members and biasing members are engaged the ink cartridge body is substantially supported and aligned by the first and second bearing points relative to the first and second elongate guide rails and the printhead translation mechanism is substantially unsupported by the elongate guide rails.

17. The printhead translation mechanism of claim 15, wherein the biasing mechanism further comprises:

a latch disposed proximate the first end of the translation mechanism for rotatably engaging a first latching member located adjacent to the first bearing point of the ink cartridge body, the latch and first latching member operable to bias the printhead translation mechanism away from the first elongate guide rail when engaged, a biasing member located on the second end of the translation mechanism for engaging a second latching member located adjacent to the second bearing point of the ink cartridge body, the second latching member and biasing member operable to bias printhead translation mechanism away from the second elongate guide rail when engaged, and wherein when the latching members and biasing members are engaged the ink cartridge body is substantially supported and aligned by the first and second bearing points located on the ink cartridge body relative to the first and second guide rails and the printhead translation mechanism is substantially unsupported by the elongate guide rails.

18. The printhead translation mechanism of claim 15 further comprising:

a first translation mechanism portion for releasably attaching to a first ink cartridge body having at least one printhead located in a first printhead location of the first ink cartridge body, and a second translation mechanism portion for releasably attaching to a second ink cartridge body having at least one printhead located in a second printhead location of the second ink cartridge body, the first and second translation mechanism portions being positioned relative to one another to independently move their respective cartridge bodies relative to the elongate guide rails.

19. The printhead translation mechanism of claim 18, wherein the first ink cartridge body and second ink cartridge body further comprise a biasing means located on a complimentary exterior surface of each ink cartridge body, thereby maintaining a predetermined spatial relationship between the first ink cartridge body and the second ink cartridge body.

20. A printing mechanism for use in an ink jet printer, the printing mechanism comprising:

at least one ink cartridge body for accommodating at least one ink cartridge, the ink cartridge body including:

a molded or cast structure having an open-ended cavity therein for slidably engaging at least one ink cartridge, at least one printhead attached to the ink cartridge body in a printhead location thereon opposite the open-ended cavity, and at least two bearing points at predetermined locations on the ink cartridge body relative to at least two spaced-apart elongate guide rails in the printer carriage area for aligning the printhead relative to print media in the printer, and an ink cartridge body carrier having first and second ends removably attached to the at least one ink cartridge body for moving the at least one ink cartridge body located in a printer carriage area of the ink jet printer along the elongate guide rails, the ink cartridge body carrier comprising a biasing mechanism for biasing the carrier away from the elongate guide rails when the carrier is removably attached to the ink cartridge body.

21. The printing mechanism of claim 20, further comprising a translation device attached to the ink cartridge body carrier for bidirectionally translating the ink cartridge body carrier in a direction orthogonal relative to print media movement in the ink jet printer.

22. The printing mechanism of claim 20, wherein the ink cartridge body releasably maintains at least one ink cartridge containing ink.

* * * * *